US009567035B2

(12) United States Patent
Chen

(10) Patent No.: US 9,567,035 B2
(45) Date of Patent: Feb. 14, 2017

(54) MEANS OF WATER SURFACE TRANSPORT

(71) Applicant: Zhencheng Chen, Beijing (CN)

(72) Inventor: Zhencheng Chen, Beijing (CN)

( * ) Notice: Subject to any disclaimer, the term of this patent is extended or adjusted under 35 U.S.C. 154(b) by 0 days.

(21) Appl. No.: 14/769,105

(22) PCT Filed: Feb. 20, 2014

(86) PCT No.: PCT/CN2014/072325
§ 371 (c)(1),
(2) Date: Aug. 20, 2015

(87) PCT Pub. No.: WO2014/127723
PCT Pub. Date: Aug. 28, 2014

(65) Prior Publication Data

US 2016/0001848 A1 Jan. 7, 2016

(30) Foreign Application Priority Data

Feb. 20, 2013 (CN) ..... 2013 1 0054313

(51) Int. Cl.

| | |
|---|---|
| ***B63B 1/16*** | (2006.01) |
| ***B63B 1/04*** | (2006.01) |
| ***B63B 3/00*** | (2006.01) |
| ***B63B 1/12*** | (2006.01) |
| *B63B 1/20* | (2006.01) |

(52) U.S. Cl.
CPC ..... *B63B 1/042* (2013.01); *B63B 1/125* (2013.01); *B63B 3/00* (2013.01); *B63B 2001/201* (2013.01); *B63B 2001/208* (2013.01)

(58) Field of Classification Search
CPC ..... B63B 1/042; B63B 1/20; B63B 1/16; B63B 1/08; B63B 2001/325; B63B 2001/201
See application file for complete search history.

(56) References Cited

U.S. PATENT DOCUMENTS

| | | | | |
|---|---|---|---|---|
| 2,515,005 A * | 7/1950 | Hickman | ..... | B63B 1/20 114/288 |
| 3,602,179 A | 8/1971 | Cole | | |
| 4,722,294 A | 2/1988 | Bruning | | |
| 5,016,552 A | 5/1991 | Ludlow | | |

(Continued)

FOREIGN PATENT DOCUMENTS

| | | |
|---|---|---|
| CN | 1121882 A | 5/1996 |
| CN | 2228055 Y | 5/1996 |

(Continued)

*Primary Examiner* — Andrew Polay
(74) *Attorney, Agent, or Firm* — Ling Wu; Stephen Yang; Ling and Yang Intellectual Property

(57) ABSTRACT

A water surface transport means, comprising a bottom (1), boards (2), a deck (3), surge diversion grooves (4) and wave suppression diversion baffles (5), the surge diversion groove (4) being provided in a space between a bottom surface vertically recessed into the hull bottom (1) and the deck (3) and extending from the bow to the stern, with an arc-shaped transverse section and a top line of longitudinal section being lower in the front and higher in the rear; a top transverse section of the wave suppression diversion baffle (5) being arc-shaped and a top line of longitudinal section being lower in the front and higher in the rear. The water surface transport means can be configured as mono-hull, catamaran and trimaran.

5 Claims, 6 Drawing Sheets

(56) References Cited

U.S. PATENT DOCUMENTS

| | | | | |
|---|---|---|---|---|
| 5,231,949 | A | 8/1993 | Hadley | |
| 5,934,218 | A * | 8/1999 | Chen | B63B 1/042 114/288 |
| 9,238,499 | B1 * | 1/2016 | Viviani | B63B 1/08 |

FOREIGN PATENT DOCUMENTS

| | | | | |
|---|---|---|---|---|
| CN | 1468776 | A | 1/2004 | |
| CN | 103121495 | A | 5/2013 | |
| CN | 203158190 | U | 8/2013 | |
| FR | 2484354 | A1 * | 12/1981 | B63B 1/042 |

* cited by examiner

MEANS OF WATER SURFACE TRANSPORT

TECHNICAL FIELD

The embodiments of the present invention relate to a water surface transport means used in the technical field of waterway transport.

BACKGROUND OF THE RELATED ART

At present, vehicles used for waterway transport, i.e., all sorts of vessels, include:

General displacement vessels, which have good stability and can satisfy the demands of large-, medium- or small-tonnage, but due to deep draft, big water resistance and the larger the tonnage is, the deeper the draft is, have high energy consumption so that it is difficult to improve the speed.

Hydrofoil crafts, which have reduced water resistance due to shallow draft so that the speed is improved but have weaker maneuverability, seaworthiness and dirigibility and are difficult to navigate in fast-flowing, shallow watercourse and to navigate steadily in strong wind and big waves.

Hovercrafts, which are free from water resistance so that the speed is improved, but need large power to generate air cushion and have high energy consumption so that it is uneconomical to use them in passenger and cargo transport. In addition, hovercrafts have weak anti-wave performance, and in particular, its advantage disappears under the attack of crosswind.

General planing crafts, which have shallow draft during gliding so that the speed is improved, but adopt a hull bottom of V-type transverse section so as to improve their own course, transverse stability and operating performance, resulting in increased wetted surface to increase frictional resistance, and have big lift force in the bow and smaller lift force in the stern, so that the water surface surge height at the bow increases to increase the resistance, and be sensitive to wave response and have poor anti-wave performance.

Except for the displacement vessels, the large limitation of tonnage is another common weakness for all of the above vessels. In addition, a common water surface transport means in the related art is limited in speed due to its structure form; when the speed is greater than 50 knots, it will generate a phenomenon that the stability becomes worse; if the propulsive power is further increased, not only will the speed not be increased, but it will result in the loss of stability so that the danger of overturning occurs.

CONTENT OF THE INVENTION

The water surface transport means provided in the embodiments of the present invention can be free from great water resistance to the greatest extent to increase its speed and meanwhile can make full use of hydrodynamic buoyancy stirred up by its own movement to load a self-weight and a load so as to satisfy the demands of various tonnages, utilizing useless energy dissipated by water wave movement to be converted into hydrodynamic propulsive force to accomplish useful work, thereby highly improving the speed and course stability, and utilizing hydrodynamic lift to improve longitudinal and lateral stability. The layout of a surge diversion groove top line that is lower in the front and higher in the rear is used to focus hydrodynamic centrifugal force on the stern when making a turn, thereby forming a hydrodynamic gyration-aided moment relative to the center of gravity of vessel, causing hydrodynamic lift, forming an anti-hull centripetal overturning righting moment relative to the center of gravity of vessel. Under the effect of these forces and the corresponding righting moments, the vessel is forced to steadily and rapidly make a turn by a very small gyration radius without occurrence of the danger of overturning, that is, its dirigibility and manoeuvrablility are highly improved. Strong enough hydrodynamic contra-impact force, hydrodynamic centrifugal force, hydrodynamic lift and corresponding hydrodynamic moment are aroused when running in stormy waves, thus the seakeeping and anti-wave performances of the vessel are highly improved.

A water surface transport means according to the embodiments of the present invention comprises a bottom, boards, a deck, surge diversion grooves and wave suppression diversion baffles, the surge diversion grooves being provided in a space between a bottom surface vertically recessed into the hull bottom and the deck, the surge diversion grooves extending from the bow to the stern, and having an arc-shaped transverse section and a top line of a longitudinal section being lower in the front and higher in the rear; a top transverse section of the wave suppression diversion baffles being arc-shaped and a top line of a longitudinal section being lower in the front and higher in the rear.

The water surface transport means may be a mono-hull form, a top line curve of the wave suppression diversion baffles and the surge diversion grooves extends backward from a starting point of the bow to a first point by 0°, extends from the first point to a second point by a first tilt angle, extends from the second point to a third point by a second tilt angle, extends from the third point to a fourth point by a third tilt angle, and extends upward and backward from the fourth point to a fifth point by a fourth tilt angle, wherein the first tilt angle, the second tilt angle, the third tilt angle and the fourth tilt angle progressively increase by an angle of larger than 0° and less than 5°; a fifth tilt angle sharply increases by 8°-13° from the fifth point, a sixth tilt angle progressively decreases from 5° from the sixth point and to 1°-0° at a seventh tilt angle, and an eighth point intersects the stern.

The water surface transport means further may be a catamaran, comprising a left-side hull and a right-side hull, the left-side hull and the right-side hull being connected by a connection bridge, wave suppression diversion baffles being respectively provided on inner side boards of the left-side hull and the right-side hull, the wave suppression diversion baffles extending forward and downward a first length at an inflection point close to a midship by a first oblique angle, extending backward and upward a second length by a ninth tilt angle, and extending backward and upward a third length by a tenth tilt angle to intersect with a waterline, wherein the ninth tilt angle is much larger than the first oblique angle and tenth tilt angle. Preferably, a width of the wave suppression diversion baffles is widened from zero at a front end to one quarter of the length of the first length, and thereafter the width remains constant, extending backward to a terminal end.

The water surface transport means further may be a trimaran, comprising a left-side hull, a right-side hull and a middle hull, the left-side hull, the right-side hull and the middle hull being connected by connection bridges, wave suppression diversion baffles being respectively provided on two hull sides of the middle hull and on inner side boards of the left-side hull and the right-side hull. Preferably, the wave suppression diversion baffles of the left-side hull and the right-side hull extend forward and downward from an inflection point close to a midpoint by a third oblique angle to a starting point of the wave suppression diversion baffles, extend backward and upward from the inflection point by a thirteenth tilt angle to a position close to one third of the length of the wave suppression diversion baffles, and then extend upward and backward by a fourteenth tilt angle to a terminal point of the wave suppression diversion baffles; the thirteenth tilt angle is much larger than the third oblique angle and the fourteenth tilt angle. The wave suppression diversion baffles of the middle hull extend forward and downward from an inflection point close to a midpoint by a second oblique angle to a starting point of the wave suppression diversion baffles, extend backward and upward from the inflection point by an eleventh tilt angle to a position close to one third of the length of the wave suppression diversion baffles, and then extend upward and backward by a twelfth tilt angle to a terminal point of the wave suppression diversion baffles; the eleventh tilt angle is much larger than the second oblique angle and the twelfth tilt angle.

BRIEF DESCRIPTION OF DRAWINGS

The embodiments of the water surface transport means according to the embodiments of the present invention will be described in detail below in conjunction with accompanying drawings.

PREFERRED EMBODIMENTS OF THE PRESENT INVENTION

The embodiments of the present invention will be described in detail below in conjunction with accompanying drawings. It should be illustrated that, without conflict, the embodiments in the present application and the features in the embodiments can be combined with each other randomly.

Figure 1:
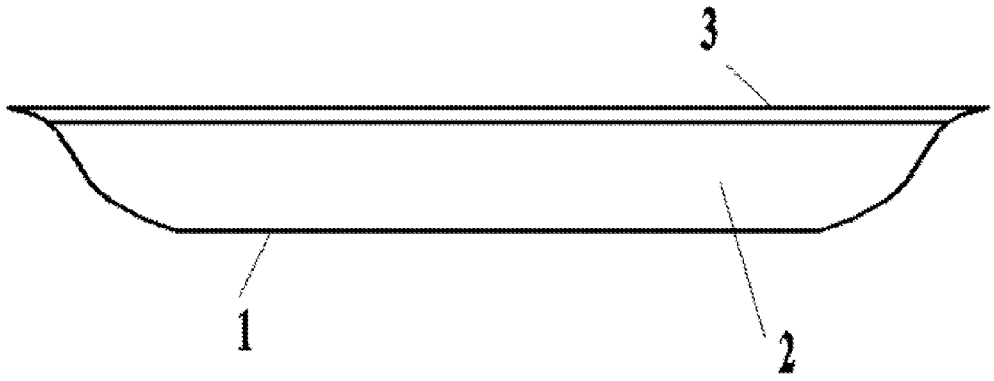
FIG. 1 is a side view of a mono-hull water surface transport means according to an embodiment of the present invention.
Figure 2:
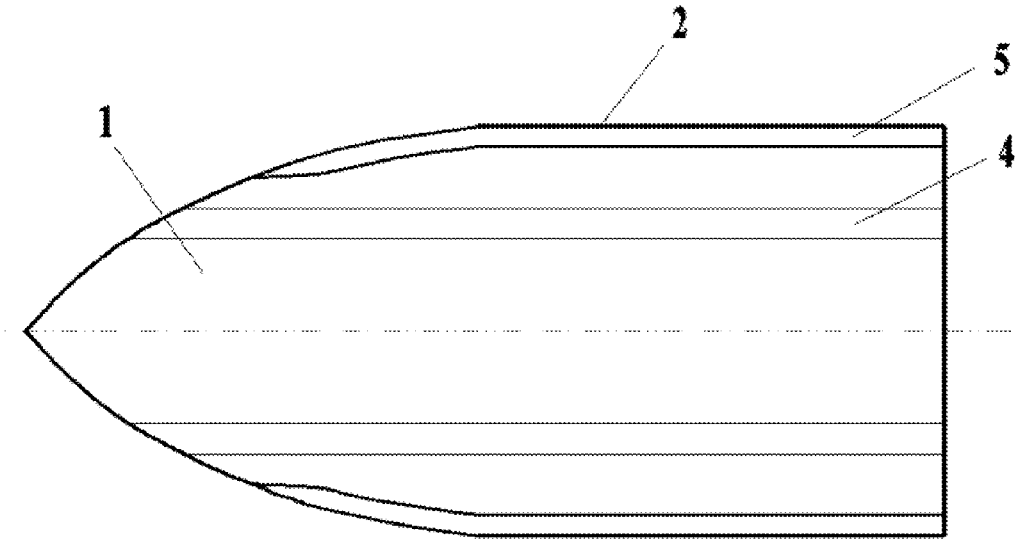
FIG. 2 is a bottom view of the mono-hull water surface transport means according to an embodiment of the present invention.
Figure 3:
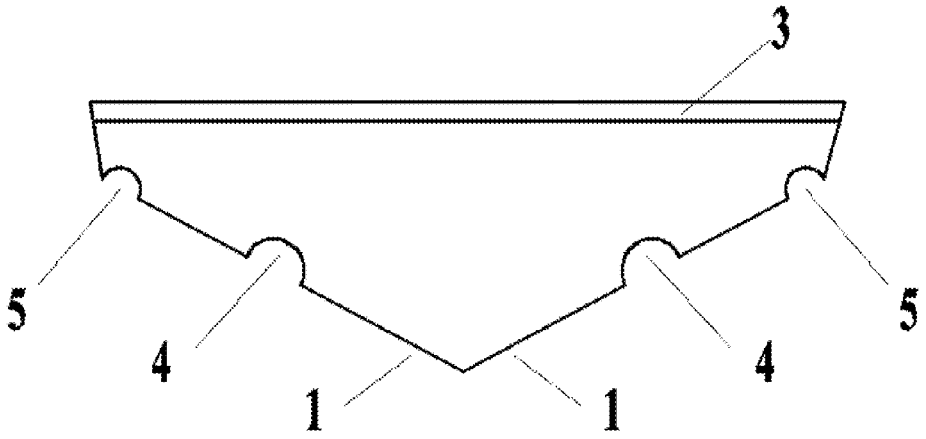
FIG. 3 is a rear view of the mono-hull water surface transport means according to an embodiment of the present invention.
Figure 4:
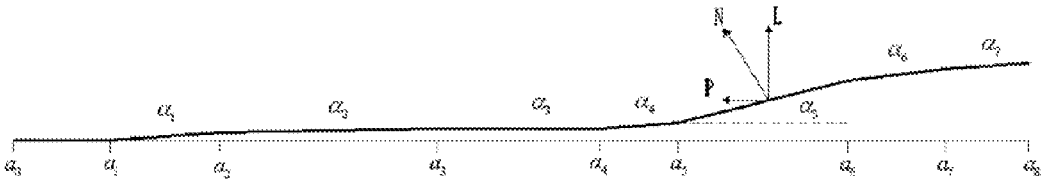
FIG. 4 is a structural diagram of a top line of the wave suppression diversion baffles of the mono-hull water surface transport means.

FIGS. 1-4 show structural diagrams of a mono-hull water surface transport means according to the embodiments of the present invention, FIG. 1 is a side view, FIG. 2 is a bottom view, FIG. 3 is a rear view, and FIG. 4 is a structural diagram of top lines of the surge diversion grooves and the wave suppression diversion baffles. Reference sign 1 represents a hull bottom, reference sign 2 represents hull sides, reference sign 3 represents a deck, reference sign 4 represents surge diversion grooves and reference sign 5 represents wave suppression diversion baffles; $\alpha_0$-$\alpha_8$ represent projections of the knots with the tilt angle changes of a top line on the baseline of the hull bottom, and $\alpha_1$-$\alpha_8$ represent tilt angles of the respective segments of the top line relative to the projective plane of the bottom.

The mono-hull water surface transport means according to the embodiments of the present invention comprises a bottom 1, boards 2, a deck 3, surge diversion grooves 4, and wave suppression diversion baffles 5, wherein the transverse section of the bottom 1 is shallow V- or deep V-type or round bilge type, and surge diversion grooves 4 are provided in a space between a bottom surface vertically recessed into the hull bottom 1 and the deck 3. The surge diversion grooves 4 extend from the bow to the stern, and have an arc-shaped transverse section and a top line of a longitudinal section is lower in the front and higher in the rear. The transverse sections of the surge diversion grooves 4 and the wave suppression diversion baffles 5 are arc-shaped, the top line is a curve that is lower in the front and higher in the rear, the curve extends backward from a starting point $\alpha_0$ of the bow to a first point $\alpha_1$ by $\alpha=0°$, extends from the first point $\alpha_1$ by a first tilt angle $\alpha_1$ to a second point $\alpha_2$, extends from the second point $\alpha_2$ by a second tilt angle $\alpha_2$ to a third point $\alpha_3$, extends from the third point $\alpha_3$ by a third tilt angle $\alpha_3$ to a fourth point $\alpha_4$, and extends upward and backward from the fourth point $\alpha_4$ by a fourth tilt angle $\alpha_4$ to a point $\alpha_5$, wherein $\alpha_1$-$\alpha_4$ progressively increases by an angle of larger than 0° and less than 5°. A fifth tilt angle $\alpha_5$ sharply increases by 8°-13° from the fifth point $\alpha_5$, a sixth tilt angle $\alpha_6$ from a sixth point $\alpha_6$ progressively decreases from 5° and decreases to 1°-0° at a seventh tilt angle $\alpha_7$. An eighth point $\alpha_8$ intersects the stern.

A top transverse section of the wave suppression diversion baffles 5 is arc-shaped, a top line of a longitudinal section is lower in the front and higher in the rear and laterally bended to the bow along the board to intersect the board, a width of tail end of the wave suppression diversion baffles 5 is assumed to be l. A width of tail end of the surge diversion grooves 4 is 2l and decreases forwardly; a height of tail end of the surge diversion grooves 4 is h and h=0 when decreases forwardly to the first point $\alpha_1$.

When the vessel advances, a water surface surge height adjacent the bow is lowered since the water flow partially enters into the surge diversion grooves 4 and the wave suppression diversion baffles 5, and meanwhile, the water flow at the outboard of two boards 2 also partially enters into the surge diversion grooves 4 and the wave suppression diversion baffles 5, thereby lowering a surge height of side edges and resulting in reduced water resistance. Subject to pushing of the moving bottom, the water flow under the bottom is squeezed from sides into the surge diversion grooves 4 and the wave suppression diversion baffles 5, converges with the water flow swarmed from the front and is guided to the stern, and smoothly flows out from the stern. Due to a structural layout of top curved surfaces of the surge diversion grooves 4 and the wave suppression diversion baffles 5 that is lower in the front and higher in the rear, the water flow entering into the grooves or baffles can cause a great normal pressure N to the top curved surfaces, as illustrated in FIG. 4. A component of the normal pressure N in a horizontal direction is consistent with the direction of navigation, i.e., it is hydrodynamic propulsive force P, which, together with the P on grooves or baffles at the other side, forms a pair of hydrodynamic propulsive forces symmetrically parallel to a longitudinal central axis of the vessel, thereby constituting a strong course stability righting moment for the center of the vessel, guaranteeing the stable course of the vessel without deviating from an intended target. A component L of the normal pressure N in a vertical direction, i.e., it is hydrodynamic lift, which forms a longitudinal stability righting moment for the center of gravity of the vessel to overcome pitching and slapping and meanwhile forms a lateral stability righting moment of the hull to overcome rolling and swinging. Accordingly, the speed and course stability, longitudinal stability and lateral stability during advancing of the vessel are significantly improved. At the same time, the higher the speed is, the stronger the hydrodynamic propulsive force and the hydrodynamic lift correspondingly are, so the course stability, longitudinal stability and lateral stability are correspondingly stronger, directly resulting in a special advantage of the vessel that the faster the speed is, the higher the stability and safety are. If the propulsive power is further increased after the speed is greater than 50 knots, the speed will break through a speed barrier to reach 60 knots, 70 knots and even a higher level, without occurrence of the danger of overturning. The reason is that the mono-hull water surface transport means according to the embodiments of the present invention is guaranteed by the foresaid strong hydrodynamic forces and the corresponding hydrodynamic moments. Based on structural features of a wetted surface of the water surface transport means according to the embodiments of the present invention, the specific hydrodynamic propulsive force, hydrodynamic lift and corresponding hydrodynamic moments occur in the hydrodynamic flow field, thereby improving the stability when improving the speed.

When the vessel makes a turn, the vertical area of the longitudinal section of the surge diversion grooves 4 in the stern is much larger than that in the bow, and referring to FIG. 4, it is from the fifth point $\alpha_5$, the sixth point $\alpha_6$, the seventh point $\alpha_7$ to the eight point $\alpha_8$ in the stern and from the fourth point $\alpha_4$, the third point $\alpha_3$, the second point $\alpha_2$ to the first point $\alpha_1$ in the bow. It can be known that the centrifugal pressure acted on a vertical wall surface in the stern is much greater than the centrifugal pressure on the wall surface in the bow. Accordingly, a hydrodynamic gyroscopic moment is constituted relative to the center of gravity of the vessel, the direction of which is consistent with the direction of a gyroscopic moment caused by the rudder, aiding in gyration of the ship, and thus it is called a hydrodynamic gyration-aided moment.

In addition, there is only one angular velocity when making a turn, but the distances of the respective surge diversion grooves from the center of gyration are different, resulting in different linear velocities. Thus, different hydrodynamic propulsive forces occur in the respective diversion grooves, the hydrodynamic propulsive force far from the center is larger than the hydrodynamic propulsive force close to the center, and then another group of hydrodynamic gyration-aided moments is constituted. Similarly, the hydrodynamic lifts in the respective grooves are in the same direction but in different positions and have different values, leading to a hydrodynamic anti-hull centripetal overturning righting moment. Under the simultaneous action of these forces and moments, the vessel is forced to automatically remain lateral inclination of about 12° of the hull, swiftly and steadily completing turning, and the gyration radius is very small and is about a quarter of a conventional vessel. When a general conventional vessel makes a turn, a hydrodynamic gyration-aided moment and a hydrodynamic anti-hull centripetal overturning righting moment cannot occur in the hydrodynamic flow field, so it has to reduce the speed when making a turn and control a rudder angle such that the turning operation is only allowed when the lateral inclination of the hull is less than 12°; otherwise, centripetal overturning of the vessel will occur. Therefore, the conventional vessel is slower when making a turn and has a gyration radius four times larger than that of the present vessel.

When the vessel advances into waves, the velocity of water flow entering into the diversion grooves is strengthened by superposition of the navigation speed and the wind and waves impact speed, thereby arousing strong hydrodynamic contra-impact force, constituting a course stability righting moment for the center of gravity of the vessel and guaranteeing the course stability of the vessel; hydrodynamic lift occurring together with the hydrodynamic contra-impact force constitutes longitudinal stability, and a lateral stability righting moment of the vessel is able to resist jolting and stalling, yaw swinging, and pitching and slapping of the vessel, thus the vessel is forced to ride wind and waves and advance steadily at a high speed. The hydrodynamic contra-impact force, the corresponding hydrodynamic lift and the corresponding righting moments cannot occur when a common vessel advances into waves, thus under the impact of head seas, due to jolting and stalling, pitching and slapping, rolling and shaking and sharply reduced speed, it is unstable and unsafe.

When the vessel makes a turn in head seas, the hydrodynamic contra-impact force and hydrodynamic gyration-aided moment caused by the hydrodynamic centrifugal force occur in the flow field of the vessel according to the embodiments of the present invention, the hydrodynamic lift occurring corresponding to the hydrodynamic contra-impact force constitutes a strong enough hydrodynamic anti-hull centripetal overturning righting moment. Their combined effect forces the vessel to be able to steadily, safely complete turning at a high speed in wind and waves without occurrence of the danger of centripetal overturning. However, a common vessel does not have such forces and moments, so it is difficult to make a turn in wind and waves, and is under greater danger of centripetal overturning and is more unstable and unsafe.

Figure 5:
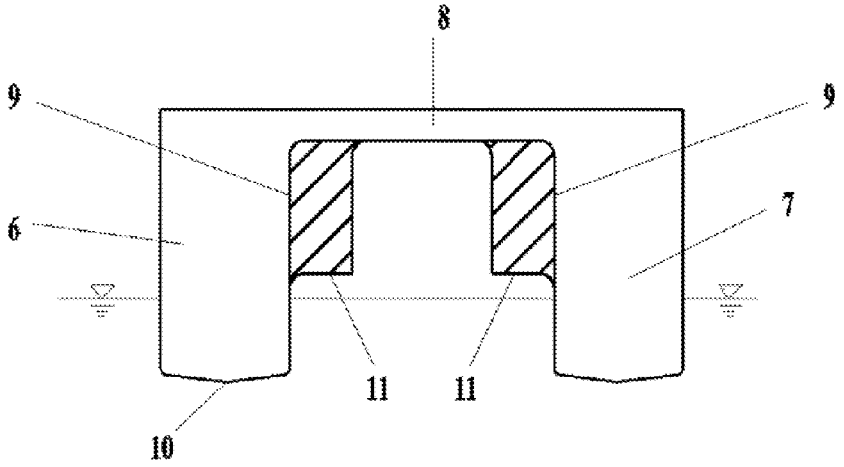
FIG. 5 is a rear view of a catamaran water surface transport means according to an embodiment of the present invention.
Figure 6:
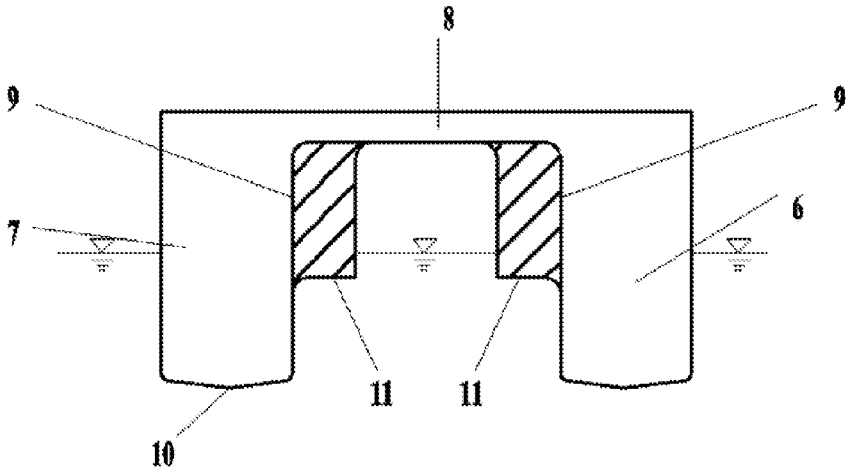
FIG. 6 is a front view of the catamaran water surface transport means according to an embodiment of the present invention.
Figure 7:
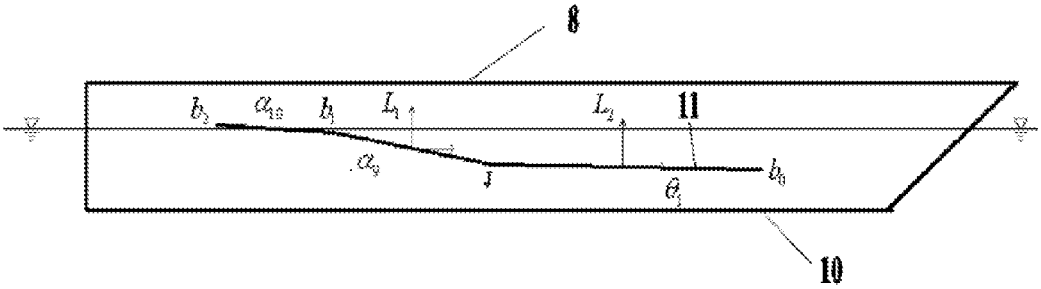
FIG. 7 is a side view of the catamaran water surface transport means according to an embodiment of the present invention.
Figure 8:
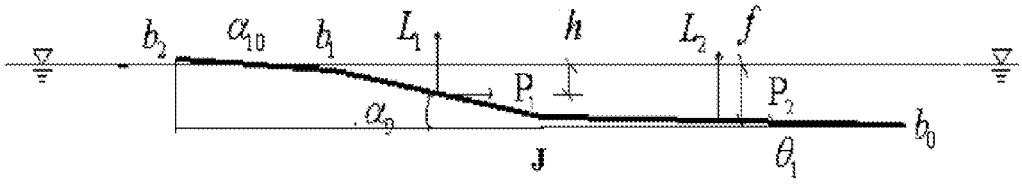
FIG. 8 is a side view of wave suppression diversion baffles.
Figure 9:
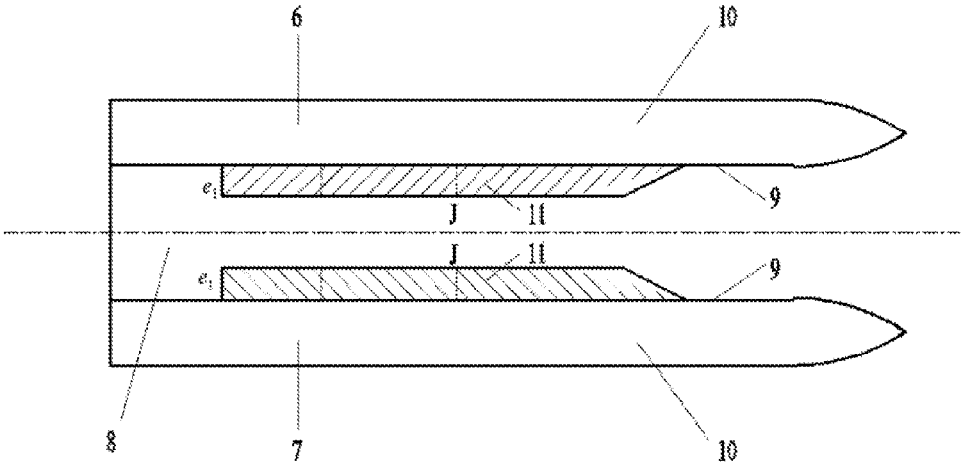
FIG. 9 is a bottom view of the catamaran water surface transport means according to an embodiment of the present invention.

FIGS. 5-9 show structural diagrams of a catamaran water surface transport means, FIG. 5 is a rear view, FIG. 6 is a front view, FIG. 7 is a side view, FIG. 8 is a side view of wave suppression diversion baffles, and FIG. 9 is a bottom view of a catamaran. Reference signs 6 and 7 respectively represent a left-side hull and a right-side hull that constitute the catamaran, 8 represents a connection bridge, 9 represents inner side boards of the two side hulls, 10 represents a hull bottom, and 11 represents wave suppression diversion baffles. Wherein, J is an inflection point of the wave suppression diversion baffles, $\theta_1$ is a downward and forward tilt angle of the wave suppression diversion baffles from point J, $\alpha_9$ is a rearward and upward tilt angle of the baffles from point J, $\alpha_{10}$ is a rearward and upward tilt angle of the baffles from point $b_1$, $b_0$ is a starting point of the wave suppression diversion baffles, and $e_1$ is a lateral width of the wave suppression diversion baffles. As shown in FIGS. 7-8, a tilt angle of a top line $b_0J$ relative to water level is $\theta_1$, a tilt angle of a top line $Jb_1$ relative to the water level is $\alpha_9$, a tilt angle of $b_1b_2$ relative to the water level is $\alpha_{10}$, $\alpha_9 \gg \theta_1$, $\alpha_9 \gg \alpha_{10}$.

As shown in FIGS. 5-6, the hull comprises a left-side hull 6 and a right-side hull 7, a connection bridge 8 connects the left-side hull 6 and the right-side hull 7, the side hull comprises hull sides 9 and a hull bottom 10. A wave suppression diversion baffle 11 is provided respectively on inner side boards of the left-side hull 6 and the right-side hull 7. The wave suppression diversion baffle 11 extends forward and downward a length $\alpha_8$ by the tilt angle $\theta_1$ at point J close to the midship, extends backward and upward a length $\alpha_9$ by the tilt angle $\alpha_9$, and then extends backward and upward a length $\alpha_{10}$ by the tilt angle $\alpha_{10}$ to intersect with the waterline, wherein $\alpha_9 \gg \theta_1$, $\alpha_9 \gg \alpha_{10}$. A width of the wave suppression diversion baffle is widened from zero at the front end to one quarter of the length of $\alpha_8$, which is $e_1$, and thereafter extend backward to the terminal end without being widened, the width $e_1$ is constant. A top transverse section of the wave suppression diversion baffles is arc-shaped, and the top line thereof is parallel to the contour line of the boards.

When the catamaran advances, a strong enough normal pressure N will be generated on the top curved surface of the wave suppression diversion baffles, a component of which in the horizontal direction is consistent with that of the navigation direction, i.e., a hydrodynamic propulsive force P. $P=P_1+P_2$, wherein $$P_1 = L_1 \frac{\sin\alpha}{\cos\alpha}, \quad P_2 = L_2 \frac{\sin\theta}{\cos\theta},$$

$$L_1 = 12\xi \frac{f-h}{\delta\sqrt{g}} a_1^2 e(\omega\sin\alpha + \gamma\sin\theta)\rho U^3 \eta\cos\alpha,$$

$$L_2 = 12\xi \frac{f-h}{\delta\sqrt{g}} a_2^2 e(\omega\sin\alpha - \gamma\sin\theta)\rho U^3 \eta\cos\theta,$$

in the formula, $$\zeta = \sqrt{1 - \frac{4n}{m\delta}}, \ \xi = \frac{\sqrt{n}}{\zeta m\sqrt{m}},$$

$$m = 3(h+f)^2 + 14h^2, \ n = h^2 f + f^3 + h^3 + f^2 h,$$

$$\omega = 1 + \frac{mf}{n}, \ \gamma = 1 + \frac{mh}{n},$$

meanwhile referring to FIGS. 5-9, wherein $\alpha_1$ is a length from point J to point $b_2$ in FIG. 8 divided by 2, $\alpha_2$ is a length of $Jb_0$ divided by 2 and e is a lateral width of the wave suppression diversion baffles. Here $\alpha$ is $\alpha_9$ in FIG. 8, $\theta$ is $\theta_1$ in FIG. 8, f is the draft at the action point $L_2$ and h is the draft at the action point $L_1$.

If the displacement is designed as W ton, the navigation speed is designed as U m/s, and the draft is designed as $\delta$ meters, hydrodynamic buoyancy caused by the wave suppression diversion baffles can be calculated according to the displacement Froude number $F_\nabla=3$, $$F_\nabla = \frac{U}{\sqrt{g\sqrt[3]{\nabla}}} 3, \ \nabla = \left[\left(\frac{U}{3}\right)^2 \Big/ 9.8\right]^3,$$

$\nabla$ in the formula is decrease of the displacement caused by the hydrodynamic buoyancy, i.e., $W-\nabla=W'$, and at this time the draft is decreased to $\delta'$ from $\delta$, $$\delta' = \frac{W' \times \delta}{W},$$

the decreased draft $r=\delta-\delta'$.

Point J is placed H higher than the baseline of the hull bottom, the forward and downward angle $\theta$ extends $\alpha_2$ meters from point J, which is decreased by $H'=\alpha_2 \tan\theta^0$ than H height, $f=\delta'-H+\alpha_2 \tan\theta^0$, $h=\delta'-H-\alpha_1 \tan\alpha$, $0<\eta\leq 1$ is a correction factor, which is determined by $L_1+L_2\nabla=$. $\rho$ is density of water.

Since the wave suppression diversion baffles are symmetrically provided in inner boards sides of the two side hulls, under the condition that the propulsive power is unchanged, a pair of symmetrically parallel hydrodynamic propulsive forces P that push the vessel forward force the vessel to significantly increase the navigation speed, and they are symmetrically parallel to the longitudinal centerline of the vessel, thereby constituting a strong course stability righting moment, guaranteeing that the vessel will not be off the course and navigate steadily at a high speed. A vertical component L of N is hydrodynamic lift $$L = L_1 + L_2,$$

which forms longitudinally and laterally stable righting moments for the center of gravity of the vessel and guarantees the vessel overcoming the pitching slapping and the rolling swinging to navigate steadily at a high speed. It needs to illustrate that although the configuration of wave suppression diversion baffles increases the partial wetted area, resulting in increase of frictional resistance opposite to the direction of the course, the experiments prove that the hydrodynamic propulsive force is much greater than the frictional resistance increased due to the configuration of diversion baffles, such that after subtracting the increased frictional resistance, the hydrodynamic propulsive force is still strong enough to significantly improve the navigation speed.

When the catamaran makes a turn, due to the layout of the top curved surface of the wave suppression diversion baffles that is lower in the front and higher in the rear, the hydrodynamic centrifugal pressure is focused on an inboard hull side on one side of the stern, and then a hydrodynamic gyration-aided moment is constituted for the center of gravity of the vessel. In addition, there is only one angular velocity when making a turn, the hydrodynamic propulsive force P occurring on the inboard hull side of the side hull far from the center of gyration is greater than the hydrodynamic propulsive force P occurring on the inboard hull side of the side hull close to the center of gyration, and then another group of hydrodynamic gyration-aided moments is generated to enable the vessel to steadily complete turning at a high speed with a very small gyration radius.

When the catamaran advances in head seas, the relative speed of the hull motion and water flow motion is increased such that the hydrodynamic contra-impact force is significantly improved, thereby resulting in steady course, and significant increase of the longitudinal and lateral stability. That is, the seakeeping performance is significantly improved so that the vessel can ride wind and waves and advance steadily at a high speed.

When making a turn in wind and waves, the increase of the above forces and moments ensures that the catamaran can steadily make turns in wind and waves at a high speed.

The hydrodynamic forces and corresponding hydrodynamic moments that can comprehensively improve the overall performance of the vessel will not occur in the flow field of a conventional catamaran, so the forward navigation speed is far slower than that of the catamaran in the embodiments of the present invention and the gyration radius is far larger than that of the present vessel when making a turn. When advancing in head seas, the navigation speed is largely decreased due to pitching, slapping, rolling swinging, jolting, and stalling, etc, and it is very unsteady to turn in wind and waves.

Figure 10:
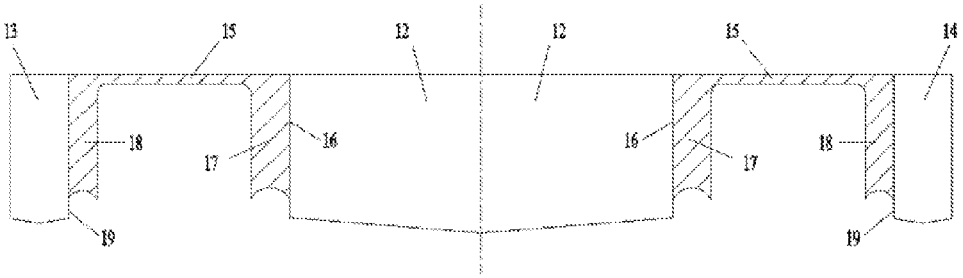
FIG. 10 is a front view of a trimaran water surface transport means according to an embodiment of the present invention.
Figure 11:
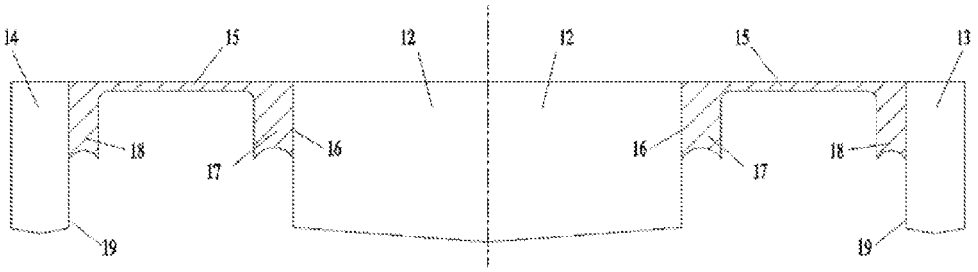
FIG. 11 is a rear view of the trimaran water surface transport means according to an embodiment of the present invention.
Figure 12:
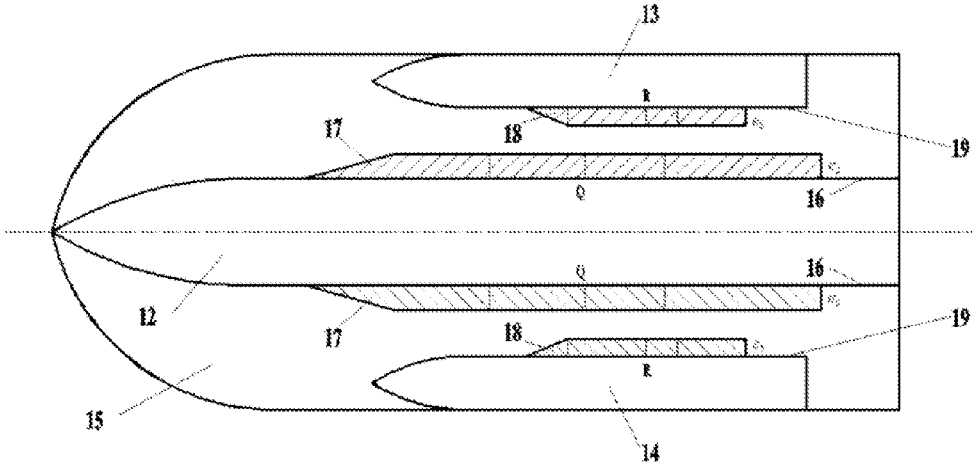
FIG. 12 is a bottom view of the trimaran water surface transport means according to an embodiment of the present invention.
Figure 13:
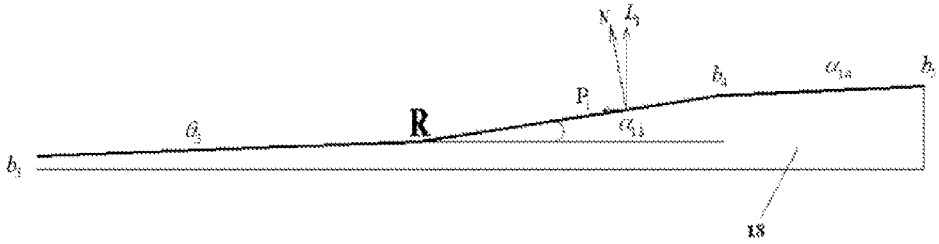
FIG. 13 is a side view of wave suppression diversion baffles of two side hulls.
Figure 14:
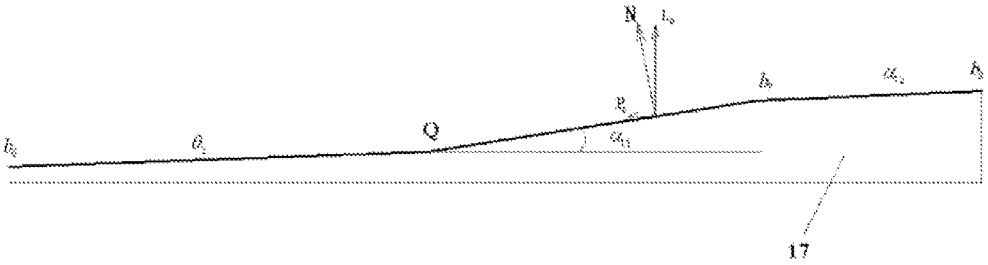
FIG. 14 is a side view of wave suppression diversion baffles of a middle hull.
Figure 15:
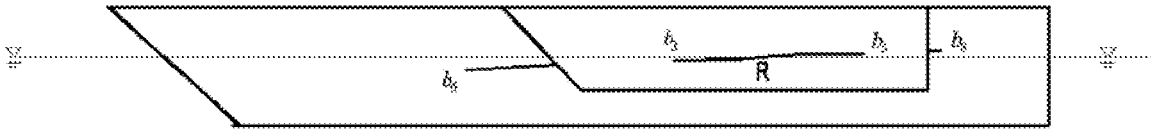
FIG. 15 is a side view of the trimaran water surface transport means according to an embodiment of the present invention.

FIGS. 10-15 show a trimaran water surface transport means, FIG. 10 is a front view, FIG. 11 is a rear view, FIG. 12 is a bottom view of a trimaran, FIG. 13 is a side view of wave suppression diversion baffles on inner side boards of two side hulls, FIG. 14 is a side view of the wave suppression diversion baffles of middle hull, and FIG. 15 is a side view of the trimaran. The reference sign 12 is a middle hull, 13 and 14 are a left-side hull and a right-side hull, respectively, 15 is a connection bridge, 16 is boards of the middle hull, 17 is wave suppression diversion baffles provided on two boards of the middle hull, 18 is wave suppression diversion baffles provided on inner side boards of the two side hulls, and 19 is inner side boards of the two side hulls. The reference sign R is an inflection point of the wave suppression diversion baffles on inner side boards of the two side hulls and is located at a position of the wave suppression diversion baffles that is close to the midpoint, Q is an inflection point of the wave suppression diversion baffles of the middle hull and is also located at a position of the wave suppression diversion baffles that is close to the midpoint, $e_2$ is a lateral width of the wave suppression diversion baffles of the middle hull, $e_3$ is a lateral width of the wave suppression diversion baffles of the two side hulls. In FIG. 13, $\theta_3$ is a forward and downward tilt angel from point R, $\alpha_{13}$ is a backward and upward tilt angle from point R, extending to point $b_4$ close to the wave suppression diversion baffles, $\alpha_{14}$ is a upward and backward tilt angle from point $b_4$, $b_3$ is a starting point of the wave suppression diversion baffles, and $b_5$ is a terminal point of the wave suppression diversion baffles, wherein $\alpha_{13}>>\theta_3$, $\alpha_{13}>>\alpha_{14}$, and N is a normal force acted on the wave suppression diversion baffles. In FIG. 14, $b_6$ is a starting point of the wave suppression diversion baffles on the hull sides of the middle hull, $b_8$ is a terminal point of the wave suppression diversion baffles on the hull sides of the middle hull, Q is an inflection point of the wave suppression diversion baffles provided on the hull sides of the middle hull, $\theta_2$ is a tilt angle extending forward and downward from point Q, $\alpha_{11}$ is a tilt angle extending backward and upward from point Q to point $b_7$ of the wave suppression diversion baffles, and $\alpha_{12}$ is a tilt angle extending upward and backward from point $b_7$, wherein $\alpha_{11}>>\theta_2$, $\alpha_{11}>>\alpha_{12}$.

When the vessel advances, a pair of hydrodynamic propulsive forces $P_0$ symmetrically parallel to the centerline of the middle hull occur respectively on the wave suppression diversion baffles of the two hull sides in the middle hull, and hydrodynamic propulsive forces $P_1$ symmetrically parallel to the centerline of the hull occur respectively on the wave suppression diversion baffles of the inboard hull sides in the two side hulls. They constitute a course stability righting moment for the center of gravity of the vessel and guarantee the course stability without deviating from an intended target. Meanwhile, corresponding hydrodynamic lifts $L_0$ and $L_1$ occur and constitute a longitudinally stable righting moment for the center of gravity of the vessel to overcome pitching slapping, and also constitute a laterally stable righting moment to overcome rolling swinging.

When the vessel makes a turn, due to a top line of a longitudinal section of the wave suppression diversion baffles that is lower in the front and higher in the rear, the wetted surface on which the centrifugal pressure in the stern acts is far larger than the wetted surface on which the centrifugal pressure in the bow acts, then the hydrodynamic gyration-aided moment is constituted for the center of gravity of the vessel. There is only one angular velocity when turning, but due to different linear speeds of the wave suppression diversion baffles that are in different distances from the center of gyration, $P_0$ and $P_1$ are different, which constitute another group of hydrodynamic gyration-aided moments for the center of gravity of the vessel. Similarly, $L_0$ and $L_1$ are in the same direction but are different in magnitude, thus constituting a hydrodynamic anti-hull centripetal overturning righting moment. Under the combined effect of these forces and moments, the vessel is forced to steadily complete turning at a high speed with a very small radius of gyration, without occurrence of the danger of overturning.

When the vessel advances in head seas, strong hydrodynamic contra-impact force and hydrodynamic lift occur on the wave suppression diversion baffles due to the increase of the relative speed of water flow motion and vessel motion. The former constitutes a strong enough course stability righting moment for the center of gravity of the vessel, the latter constitutes longitudinally and laterally stable righting moments for the vessel, they force the vessel to remain stable course in wind and waves without deviating from a target, remain longitudinal stability to overcome pitching slapping, and remain lateral stability to overcome rolling swinging, so that the vessel rides the wind and waves and advances steadily at a high speed.

When the vessel makes a turn in wind and waves, the hydrodynamic gyration-aided moment and the hydrodynamic anti-hull centripetal overturning righting moment are aroused. Under the strong effect of these forces and moments, the vessel is forced to steadily complete turning at a high speed with a very small radius of gyration without occurrence of the danger of overturning.

However, the above hydrodynamic propulsive force, hydrodynamic lift and hydrodynamic contra-impact force cannot occur in the hydrodynamic flow field when a conventional trimaran is running, the gyration-aided moment cannot occur when making a turn, the hydrodynamic contra-impact force cannot occur when advancing in head seas, and the gyration-aided moment cannot occur when making a turn in wind and waves. The course stability, lateral stability, the stability and navigation speed in turning, and seakeeping performance of a common trimaran are not to be compared with the advantages of the trimaran water surface transport means according to the embodiments of the present invention.

The wetted area of the hull of the water surface transport means designed according to the embodiments of the present invention can result in a special hydrodynamic flow field and corresponding hydrodynamic forces and hydrodynamic moments so as to comprehensively enhance the overall performance of the vessel, having important and far-reaching significance and contributions to the development of the shipbuilding industry.

Although the embodiments exhibited in the examples of the present invention are as above, the described contents are only the embodiments used to facilitate understanding of the present invention, instead of limiting the present invention. Any person skilled in the art, under the premise of without deviating from the spirit and scope of the disclosure of the present invention, may make various changes and variations in the form and details of implementation. The patent protection scope of the present invention should still be based on the scope defined by the appended claims.

INDUSTRIAL APPLICABILITY

The water surface transport means according to the embodiments in the present invention has good hydrodynamic performances, can be free from strong water resistance to the greatest extent so as to improve the navigation speed and course stability, and can enable the vessel to steadily and swiftly make a turn with a very small radius of gyration without occurrence of the danger of overturning, so that the dirigibility, maneuverability and seaworthiness are significantly improved.

What I claim is:

1. A water surface transport means, being a mono-hull, comprising a bottom (1), boards (2), a deck (3), surge diversion grooves (4) and wave suppression diversion baffles (5), characterized in that, the surge diversion groove (4) being provided in a space between a bottom surface vertically recessed into the bottom (1) and the deck (3), the surge diversion grooves (4) extending from a bow to a stern, and having an arc-shaped transverse section and a top line of a longitudinal section being lower in the front and higher in the rear; a top transverse section of the wave suppression diversion baffles (5) being arc-shaped and a top line of a longitudinal section being lower in the front and higher in the rear, top lines of the wave suppression diversion baffles (5) and the surge diversion grooves (4) extend backward from a starting point ($\alpha_0$) of a waterline to a first point ($\alpha_1$) by 0°, extend from the first point ($\alpha_1$) to a second point ($\alpha_2$) by a first tilt angle ($\alpha_1$), extend from the second point ($\alpha_2$) to a third point ($\alpha_3$) by a second tilt angle ($\alpha_2$), extend from the third point ($\alpha_3$) to a fourth point ($\alpha_4$) by a third tilt angle ($\alpha_3$), and extend upward and backward from the fourth point ($\alpha_4$) to a fifth point ($\alpha_5$) by a fourth tilt angle ($\alpha_4$), wherein the first tilt angle, the second tilt angle, the third tilt angle and the fourth tilt angle progressively increase by an angle of larger than 0° and less than 5°; a fifth tilt angle ($\alpha_5$) sharply increases by 8°-13° from the fifth point ($\alpha_5$), a sixth tilt angle ($\alpha_6$) progressively decreases from 5° from the sixth point ($\alpha_6$) and to 1°-0° at a seventh tilt angle ($\alpha_7$), and an eighth point ($\alpha_8$) intersects the stern, thus the structures of the surge diversion grooves and the wave suppression diversion baffles evoke hydrodynamic lift L and corresponding hydrodynamic propulsive force P when the mono-hull travels.

2. The water surface transport means according to claim 1, characterized in that, the transverse section of the hull bottom of the mono-hull is shallow V-or deep V-type, the surge diversion grooves (4) are symmetrically disposed at both sides of the longitudinal centerline of the hull bottom, the wave suppression diversion baffles (5) are disposed at boards sides.

3. A water surface transport means, the water surface transport means is a catamaran, comprising a left-side hull (6) and a right-side hull (7), the left-side hull (6) and right-side hull (7) being connected by a connection bridge, wherein the water surface transport means further comprising wave suppression diversion baffles (11) respectively provided on inner side boards of the left-side hull (6) and the right-side hull (7), a wave suppression diversion baffles (11), wherein a top transverse section of the wave suppression diversion baffles being arc-shaped, extending forward and downward a first length at an inflection point (J) close to a midship by A oblique angle ($\theta_1$), extending backward and upward a second length by B tilt angle ($\alpha_9$), and extending backward and upward a third length by C tilt angle ($\alpha_{10}$) to intersect with a waterline, wherein the B tilt angle ($\alpha_9$) is much larger than the A oblique angle ($\theta_1$) and the C tilt angle ($\alpha_{10}$), thus the wave suppression diversion baffles (11) evoke hydrodynamic lift $L_1$ and corresponding hydrodynamic propulsive force $P_1$ when the catamaran travels.

4. The water surface transport means according to claim 3, characterized in that, a width of the wave suppression diversion baffle (11) is widened from zero at a front end to one quarter of the length of the first length, and thereafter the width ($e_1$)remains constant, extending backward to a terminal end.

5. A water surface transport means the water surface transport means is a trimaran, comprising a left-side hull (13), a right-side hull (14) and a middle hull (12), the left-side hull (13), the right-side hull (14) and the middle hull (12) being connected by connection bridges, wherein wave suppression diversion baffles, wherein a top transverse section of the wave suppression diversion baffles being arc-shaped, being respectively provided on two boards of the middle hull (12) and on inner side boards of the left-side hull (13) and the right-side hull (14), wherein:

the wave suppression diversion baffles of the left-side hull (13) and the right-side hull (14) extend forward and downward from an inflection point (R) close to a midpoint by A oblique angle ($\theta_3$) to a starting point of the wave suppression diversion baffles, extend backward and upward from the inflection point (R) by B tilt angle ($\alpha_{13}$) to a position ($b_4$) close to one third of the length of the wave suppression diversion baffles, and then extend upward and backward by C tilt angle ($\alpha_{14}$) to a terminal point ($b_5$) of the wave suppression diversion baffles; the B tilt angle ($\alpha_{13}$) is much larger than the A oblique angle ($\theta_3$) and the C tilt angle ($\alpha_{14}$), thus the wave suppression diversion baffles evoke hydrodynamic lift $L_1$ and corresponding hydrodynamic propulsive force $P_1$ at the left-side hull and the right-side hull when the trimaran travels, and/or the wave suppression diversion baffles of the middle hull (12) extend forward and downward from an inflection point (Q) close to a midpoint by D oblique angle ($\theta_2$) to a starting point of the wave suppression diversion baffles, extend backward and upward from the inflection point (Q) by E tilt angle ($\alpha_{11}$) to a position ($b_7$) close to one third of the length of the wave suppression diversion baffles, and then extend upward and backward by F tilt angle ($\alpha_{12}$) to a terminal point ($b_8$) of the wave suppression diversion baffles; the E tilt angle ($\alpha_{11}$) is much larger than the D oblique angle ($\theta_2$) and the F tilt angle ($\alpha_{12}$), thus the wave suppression diversion baffles evoke hydrodynamic lift $L_0$ and corresponding hydrodynamic propulsive force $P_0$ at the middle hull (12) when the trimaran travels.

* * * * *